US006113430A

United States Patent [19]

Wu

[11] Patent Number: 6,113,430

[45] Date of Patent: Sep. 5, 2000

[54] LAMP SOCKET STRUCTURE

[76] Inventor: Jeng-Shyong Wu, No. 14, Alley 1, Lane 326, Shyr-Piin Road, Hsin-Chhu City, Taiwan

[21] Appl. No.: 08/918,327

[22] Filed: Aug. 26, 1997

[51] Int. Cl.[7] ..... H01R 17/00

[52] U.S. Cl. ..... 439/619

[58] Field of Search ..... 439/619, 699.2, 439/611, 356, 612, 613, 614, 615

[56] References Cited

U.S. PATENT DOCUMENTS 5,634,823 6/1997 Furuta et al. ..... 439/699.2
5,672,077 9/1997 Wang et al. ..... 439/619

FOREIGN PATENT DOCUMENTS 7329952 12/1984 Japan .

OTHER PUBLICATIONS

*Japanese Official Patent Gazette*, p. 288, May 16,1985.
*Japanese Official Patent Gazette*, p. 289, May 16,1985.

*Primary Examiner*—Brian Sircus
*Assistant Examiner*—Eugene G. Byrd
*Attorney, Agent, or Firm*—McGlew and Tuttle, P.C.

[57] ABSTRACT

A lamp socket arrangement for bulb with a lamp base having a first end defining a bulb opening for receiving the bulb. The lamp base has a second end substantially opposite from the first end. The second end includes a plurality of prongs which extend away from the second end. The lamp base is combined with a lamp holder having first and second ends, and defining a passage way between the first and second ends for receiving all of the lamp base, the plurality of prongs and the plurality of conducting wires for the bulb. The passage way, the plurality of prongs, and the plurality of conducting wires have a shape to substantially fill the second end of the passage way when the plurality of prongs and the conducting wires are positioned in the second end of the passage way. The shape of the passage way, prongs and conductors are such that the combination of all three form a sealed connection and a sealed end of the lamp socket arrangement.

21 Claims, 7 Drawing Sheets

LAMP SOCKET STRUCTURE

BACKGROUND OF THE INVENTION

The present invention is generally relating to a lamp socket structure in a Christmas lighting string and more particularly to the combination structure of the lamp bulbs connected in series or parallel whereby to form a lighting string used as a kind of decoration. In general, the conventional structure consists of main body, base, copper sheet, wire and lamp bulb. The connection of the copper sheet and wire is the taper on the copper sheet to pierce into wire under the longitudinal direction. Such is easy to hurt or cut off the copper wire with the wire so as to cause the poor contact and danger. Further, after the combination of the assemblies, the gap between each assemblies will be large so that it is easy to have the danger of electric shock.

The present invention provides the request of safety of electric appliances. the structure of copper sheet being changed and the contact method of wire, not to cause the danger of electric shock and leakage, so as to make the improvement of the lamp socket unit to obtain a novel and safe request.

The purpose of this invention is to provide a kind of lamp socket structure and consists of bulb, lamp base, lamp holder and conducting wire connected to contact sheet. The bulb is a vacuum body with two extended filaments. The lamp base arranged a neck of hole, connected to filament aperture of the filament base and extended to the pillar. The lamp holder is a hollow shell, having a pass way between two ends. When the combination of lamp socket, the contact sheet of the conducting wire is fixed into the inner side of the pass way of lamp holder, said conducting wire is outlet from one end of the pass way, the filament of bulb passed through the neck of hole and filament aperture in the lamp base. The base of vacuum body of bulb is fixed in the neck of hole of the lamp base, filaments parted into two sides of filament base in the lamp base, then arranged into one end of the pass way of said lamp base so as to make the filament of bulb and contact sheet be contacted, to conduct the electric current to form a electric circuit. Further, the pillar is filled between the inside of pass way of lamp base and conducting wire.

A conventional apparatus of "The series connection in Christmas light" disclosed on pages 288–289 in Patents Gazette of the Taiwanese Patent Application No. 7329952 with publication No. 67102 filed on Dec. 14, 1984. In said Taiwanese patent, it provides an a connecting device for a Christmas lighting string set comprising substantially a plug-in base (1) and a housing (2), wherein said plug-in base (1) has a connecting head (11) having a protrusive boss (12), a bottom having a hooked rod (13) formed integrally, and a pair of inner copper plates (17) connected with electrical power wires (16) having a copper spot (18); and said housing (2) has an opening in the upper end and a conductor hole in the bottom, a pair of outer copper plates (24) connected to electrical power source (23) having engaging holes (25); characterized in that by the connection of the above structure, the protrusive boss (12) on the plug-in base (1) slips in a hole (21) on the upper portion of the housing, the copper spot (18) on the inner copper plates slipping into clamping hole (25) on the outer copper plate (24), and the hook portion of the hooked rod (13) of the plug-in base (1) hooking the bottom of the housing in order to achieve good contacts and prevent them from loosing.

The main characteristic of this invention is the pillar of lamp base divided into two forked sheet from the near of the base of filament base, said two forked sheet being hollow slit, while combinating, said slit being pressed tightly from the inner flange of pass way or conducting wire within the lamp holder, whereby to fill the place between the inner edge of pass way and conducting wire, so as to fill up the pass way and sealed tightly. The descriptions of brief drawings are shown in the following.

DESCRIPTION OF PREFERRED EMBODIMENTS

Figure 1:
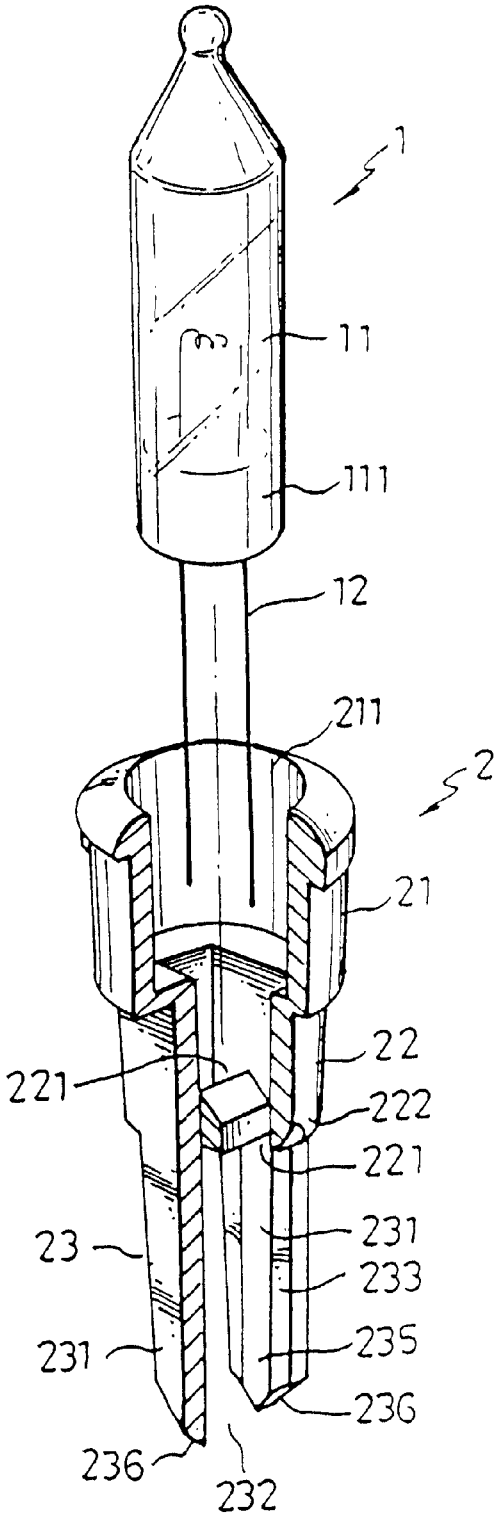
FIG. 1 is a cross-section view of the bulb and lamp base of the lamp socket structure of the present invention.
Figure 2:
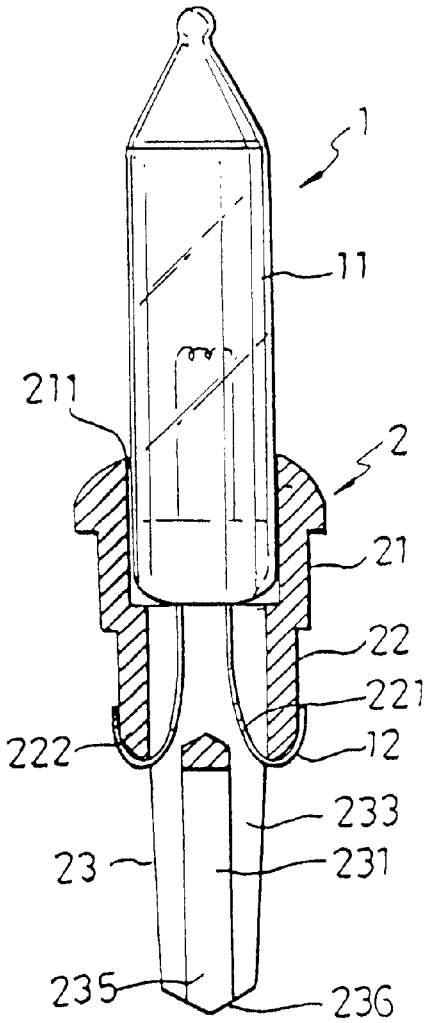
FIG. 2 is a cross-section view after the combination of bulb and lamp base.
Figure 3:
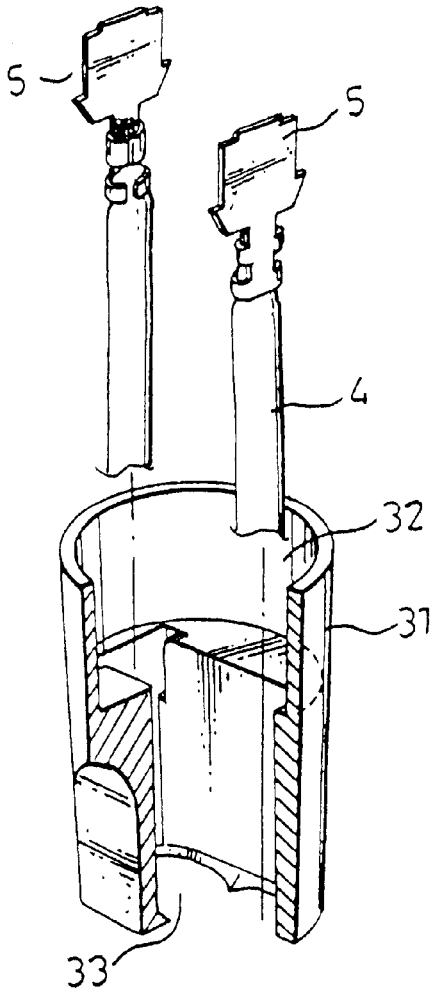
FIG. 3 is a combination view of the lamp base and conducting wire connected to copper sheet of the present invention.
Figure 4:
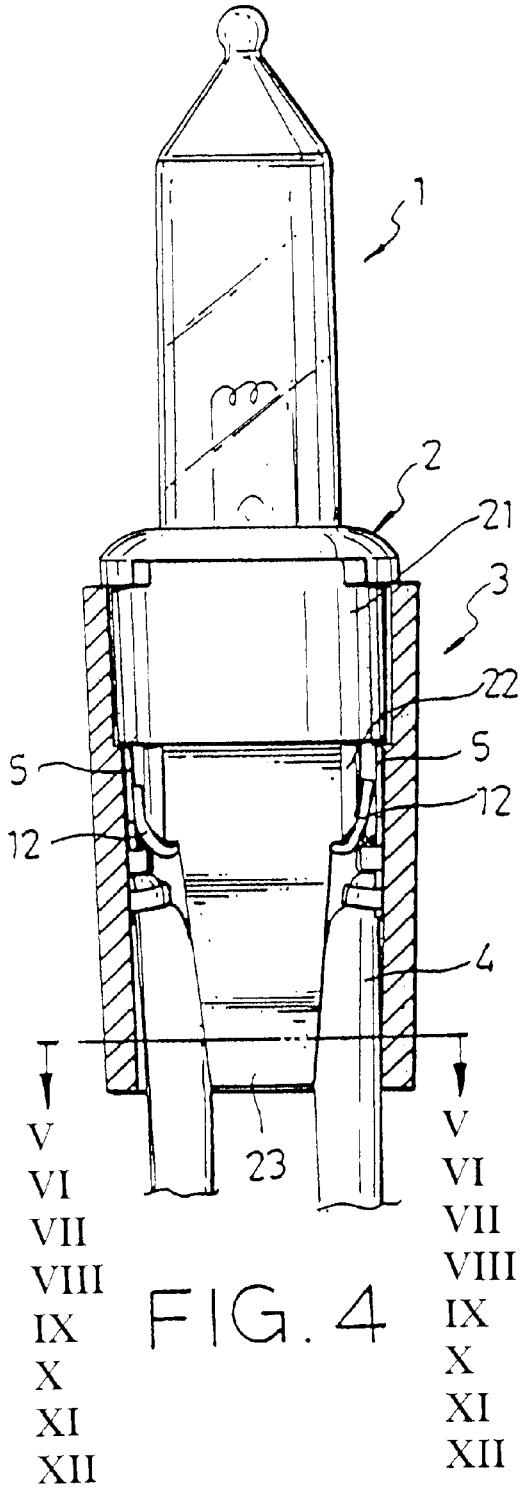
FIG. 4 is a cross-section view being the combination of bulb, lamp base, lamp holder and conducting wire connected to copper contact sheet of the lamp socket structure of the present invention.

The present invention provides the different combination on the basis of the assemblies. Such combination is suitable to the different usage, place and effect to obtain the request of safety. In order to understand the present invention completely, the descriptions are done for the preferred embodiments shown in the drawings:

Now referring to FIGS. 1, 2, 3 and 4, those drawings show the structure and combination of the assemblies of the lamp socket structure of the present invention. The lamp socket structure comprises bulb 1, lamp base 2, lamp holder 3 and conducting wire 4 connected to copper sheet 5. The bulb 1 is having a vacuum body 11, base 111 and two filaments 12 connect to tungsten filament extended to the outside of said base 111. The lamp base 2 is having a neck 21, filament base 22 and pillar 23, said neck 21 and filament base 22 being hollow with a hole 211 connected to the base of filament base to pass through, then said base 222 connected to pillar 23 and divided into two forked sheets or prongs 231, the central part of said two forked sheet 231 having hollow slit 232, the inner part of said forked sheet 231 being formed into quarter circle groove 233 and their end 235 being having slant 236. The lamp base 3 is having outer shell 31, central part of said shell being hollow, one end being a bulb fixing end 32 and the other end being an outlet 33 of conducting wire 4, between two ends provided with a pass way, the central part of said pass way fixed contact sheet 5 and conducting wire 4 to pass through the outlet 33 of pass way. While combinating, the contact sheet of the conducting wire is fixed into the inner side of the pass way of lamp holder, said conducting wire is outlet from one end of the pass way, the filament of bulb passed through the neck of hole and filament aperture in the lamp base. The base of vacuum body of bulb is fixed in the neck of hole of the lamp base, filaments parted into two sides of filament base in the lamp base, then arranged into one end of the pass way of said lamp base so as to make the filament of bulb and contact sheet be contacted, to conduct the electric current to form a electric circuit. Further, the pillar is filled between the inside of pass way of lamp base and conducting wire. The characteristic is that the pillar of lamp base divided into two forked sheet from the near of the base of filament base, said two forked sheet being hollow slit, while combinating, said slit being pressed tightly from the inner edge of pass way or conducting wire within the lamp holder, whereby to fill the place between the inner edge of pass way and conducting wire, so as to fill up the pass way and sealed tightly.

Figure 5:
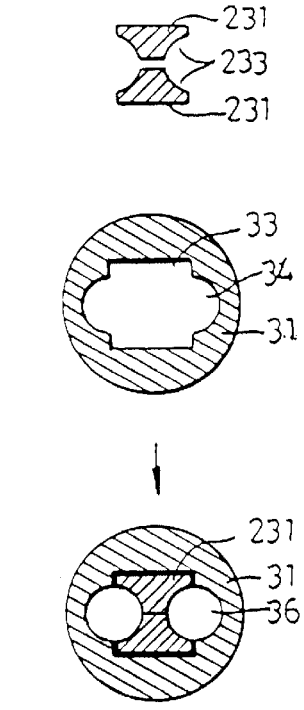
FIGS. 5, 6, 7, 8, 9, 10, 11 and 12 are the cross-section of D—D line with the various of the combination.

FIG. 5 shows a cross-section of the outlet of inner edge of pass way 33 of conducting wire to form semi-circle groove, the arc of said semi-circle being similar to the arc of outer flange of conducting wire so as to make the inner edge of the forked sheet 231 of extended pillar of lamp base relatively formed a quarter circle groove 233, its arc being similar to the outer flange of conducting wire, while combinating and pressing said forked sheet, two relative quarter circle groove 233 to form a half circle groove, then to combinate the half circle flange of inner edge of pass way to form a circle hole 36, to adjoin the conducting wire so as to fill up the pass way 33 of lamp base and sealed tightly.

Figure 6:
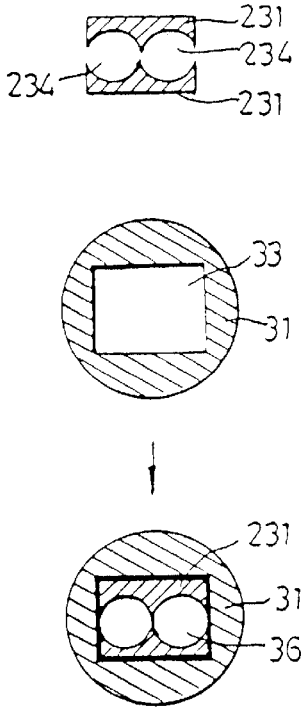

FIG. 6 shows a cross-section of the outlet of inner edge of pass way 33 of conducting wire to form two semi-circle groove, the inner edge of the forked sheet 231 extended pillar of lamp base relatively formed two half circle grooves 234, their arc being similar to the outer flange of conducting wire, while combinating and pressing said forked sheet 231, two relative half circle groove to form a circle hole 36, to adjoin two conducting wires so as to fill up the pass way 33 of lamp base and sealed tightly.

Figure 7:
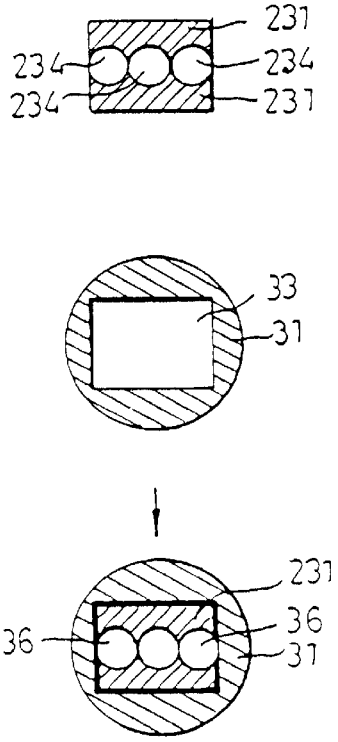
Figure 8:
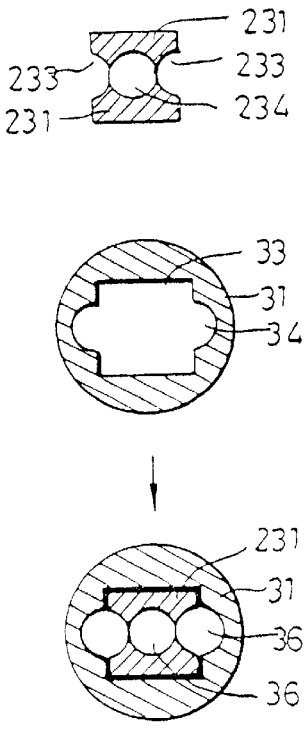

FIGS. 7 and 8 show a cross-section of the outlet of inner edge of pass way 33 of conducting wire to form three semi-circle groove, the inner edge of the forked sheet 231 of extended pillar of lamp base relatively formed three of two half circle grooves 234, their arc being similar to the outer flange of conducting wire, while combinating and pressing said forked sheet, two relative half circle grooves to form a circle hole 36, to adjoin three conducting wires so as to fill up the pass way 33 of lamp base and sealed tightly.

Figure 9:
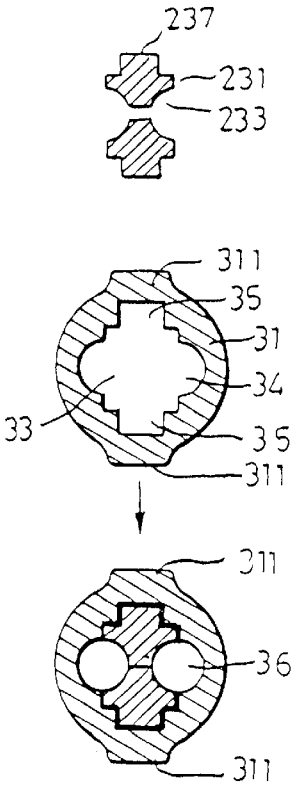

FIG. 9 shows a cross-section of the outlet of inner edge of pass way 33 of conducting wire to form two semi-circle grooves, the inner edge of pass way 33 of said conducting wire being to form semi-circle groove, the arc of said semi-circle being similar to the art of outer flange of conducting wire so as to make the inner edge of the forked sheet 231 of extended pillar of lamp base relatively formed a quarter circle groove 233, its arc being similar to the outer flange of conducting wire, the top of the forked sheet of extended pillar having a outside flange 237 which tightly connected to side concave groove 35 of pass way 33, while combinating and pressing said forked sheet 231, two relative quarter circle grooves 233 to form a half circle groove, then to combinate the half circle flange of inner edge of pass way 33 to form a circle hole 36, to adjoin the conducting wire so as to fill up the pass way of lamp base and sealed tightly.

Figure 10:
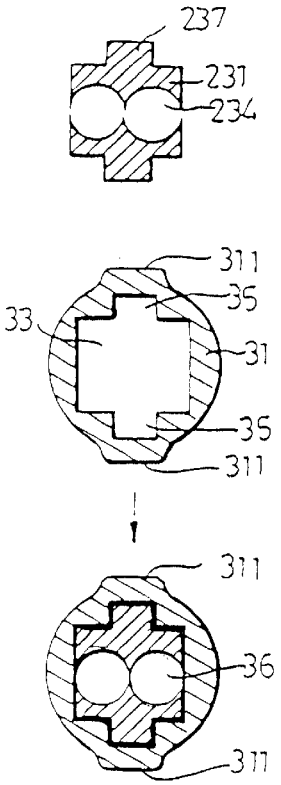

FIG. 10 shows a cross-section of the outlet of inner edge of pass way 33 of conducting wire to form two semi-circle grooves, the inner edge of the forked sheet 231 of extended pillar of lamp base relatively formed two half circle grooves 234, their arc being similar to the outer flange 237 of conducting wire, the top of the forked sheet of extended pillar having a outside flange 237 which tightly connected to side concave groove 35 of pass way 33, while combinating and pressing said forked sheet 231, each two relative half circle groove 234 to form a circle hole 36, to adjoin two conducting wires so as to fill up the pass way of lamp base and sealed tightly.

Figure 11:
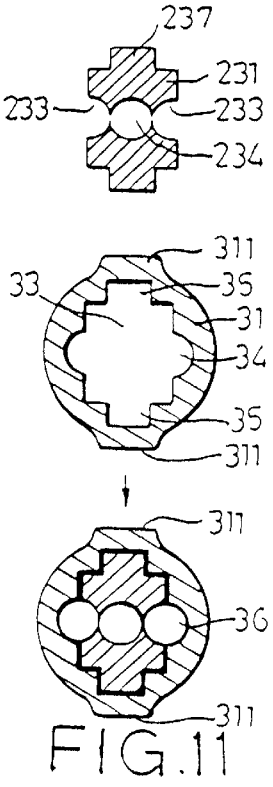
Figure 12:
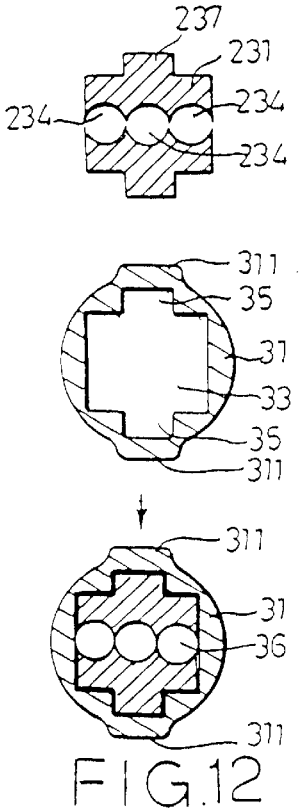

FIGS. 11 and 12 show a cross-section of the outlet of inner edge of pass way 33 of conducting wire to form three semi-circle grooves, the inner edge of the forked sheet 231 of extended pillar of lamp base relatively formed a quarter circle groove 233 and a half circle groove 234, their arc being similar to the outer flange of conducting wire, the top of the forked sheet of extended pillar having a outside flange 237 which tightly connected to side concave groove 35 of pass way 33, while combinating and pressing said forked sheet 231, each two relative quarter circle groove 233 to form a half circle groove 234, then to combinate the half circle flange of inner edge of pass way to form a circle hole 36, to adjoin the several conducting wires so as to fill up the pass way 33 of lamp base and sealed tightly.

Figure 13:
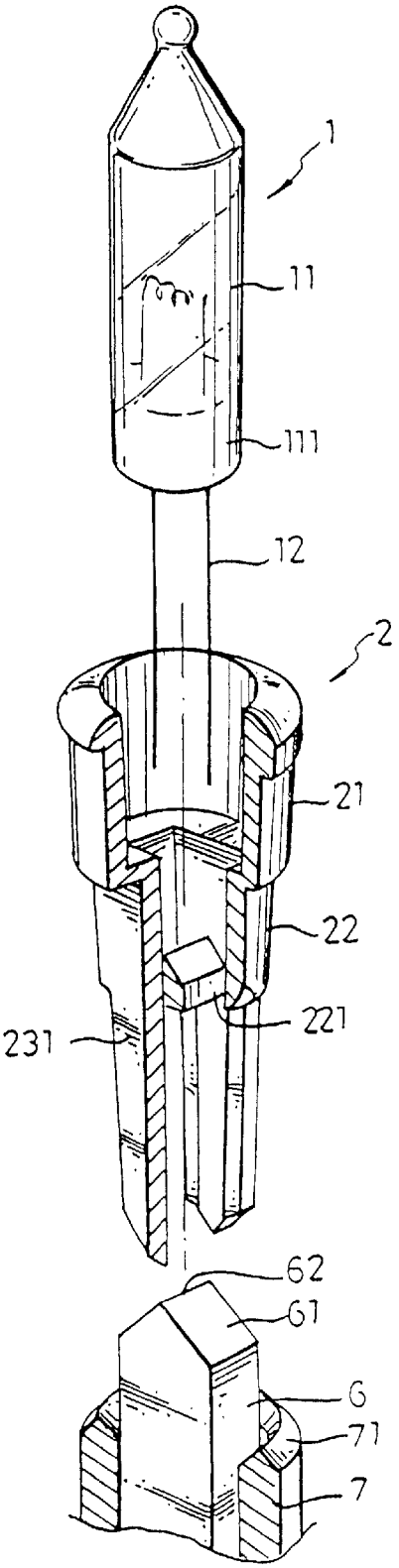
FIG. 13 is a cross-section view of the combination of parts of bulb and lamp base with slider.
Figure 14:
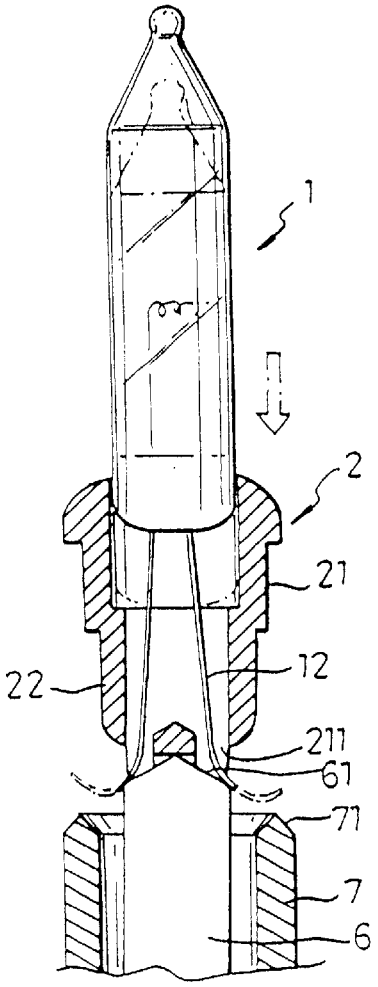
FIG. 14 is a combinating procedure of bulb and lamp base with slider.
Figure 15:
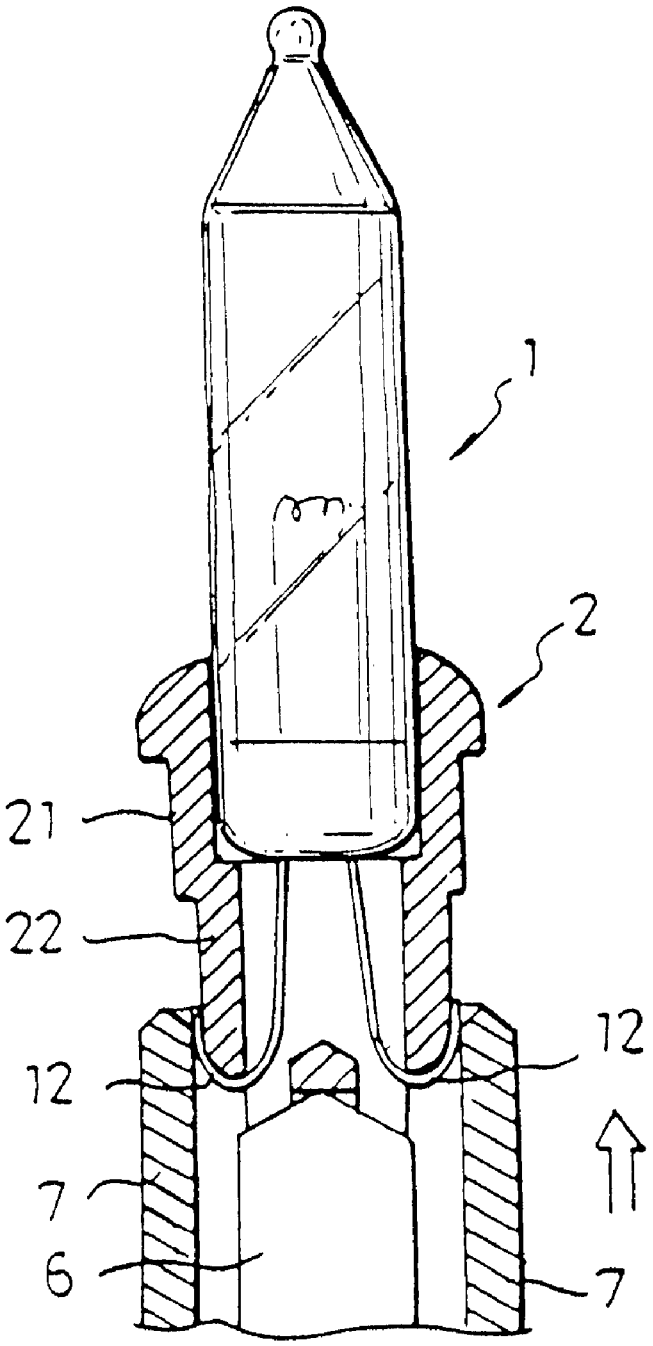
FIG. 15 is the completion of the combination of bulb and lamp base.
Figure 16:
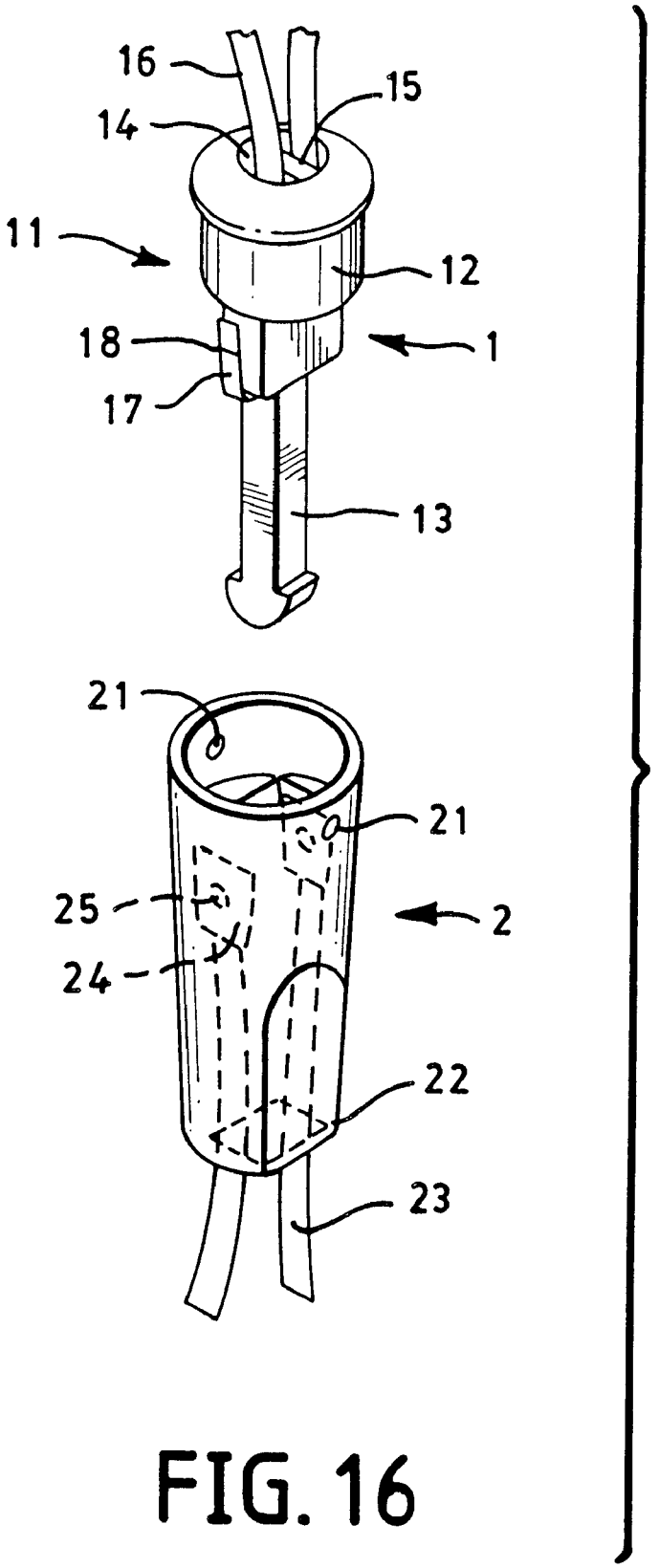
FIG. 16 is a drawing of prior art of Taiwanese Application No. 7329952.

Referring to FIGS. 13, 14 and 15, those drawings show the combinating procedure and completion of the bulb and lamp base of the present invention. A lamp socket structure comprises bulb 1, lamp base 2, lamp holder 3 and conducting wire 4 connected to contact sheet 5. The bulb 1 is having a vacuum body 11 with two extended filaments 12. The lamp base 2 arranged a neck 21 of hole, connected to filament aperture 221 of the filament base 22 and extended to the pillar. The lamp holder 3 is having a hollow shell with a pass way between two ends. When the combination of lamp socket, the contact sheet of the conducting wire is fixed into the inner edge of the pass way of lamp holder, said conducting wire is outlet from one end of the pass way, the filament 12 of bulb 1 passed through the neck 21 of hole and filament aperture 221 in the lamp base 2; the base 111 of vacuum body 11 of bulb 1 is fixed in the neck 21 of hole of the lamp base 2, filaments 12 parted into two sides of filament base 22 in the lamp base, then arranged into one end of the pass way of said lamp base so as to make the filament of bulb and contact sheet be contacted, to conduct the electric current to form a electric circuit. The pillar is filled between the inside of pass way of lamp base and conducting wire, charactered in that the pillar of lamp base divided into two forked sheets 231 from the near of the base 111 of filament base 22, said two forked sheet being hollow slit, the outer of each forked sheet having a flange, the size and shape being similar to the pass way groove of lamp base. The slit of said two forked sheets arranges with twin slant 6 and slider 7, the tip 62 of said twin slant 6 focused to the place between two filament apertures 221, said twin slant 6 focused to filament aperture 221, while filament 12 of bulb 1 being outlet of filament aperture 221, said twin slant 6 to be used to prop open filament 12 to be inclined toward the outer of filament base 22, to connect to the slider 7 of twin slant 6 moved toward the tip 62 of twin slant 6, said filament 12 pressed bent and fixed on the outer of filament base 22, then to move the twin slant 6 and slider 7; while combinating, the central part of the forked sheet slit being pressed tightly from the inner edge of pass way or conducting wire whereby to fill up and seal the pass way of lamp base.

Although the present invention has been described in terms of particular embodiments, it is not limited to these embodiments. It is possible that alternative embodiments and modifications which would still be encompassed by the present invention may be made by those skilled in the art, particularly in the light of the foregoing teachings. Therefore, it is submitted that the spirit and scope of the present invention should be interpreted and defined by the following claims.

What I claimed is:

1. A lamp socket arrangement for a bulb, the arrangement comprising:

a lamp base having a first end defining a bulb opening for receiving the bulb, said lamp base having a second end substantially opposite said first end, said second end including a plurality of prongs extending away from said second end;

a lamp holder having first and second ends and defining a passage way between said first and second ends for receiving said lamp base, said plurality of prongs, and a plurality of conducting wires, said passage way, said plurality of prongs and the plurality of conducting wires having a shape to substantially fill said second end of said passage way when said plurality of prongs and the plurality of conducting wires are positioned in said second end of said passage way.

2. The arrangement in accordance with claim 1, wherein:

said shape of said plurality of prongs is substantially complementary to a portion of the plurality of conducting wires;

said shape of said passage way is substantially complementary to a combination of said plurality of prongs with the plurality of conducting wires.

3. The arrangement in accordance with claim 1, wherein:

said plurality of prongs form a sealed connection between said lamp holder and the plurality of conducting wires.

4. The arrangement in accordance with claim 1, wherein:

said shape of said passage way presses said plurality of prongs in a sealing contact against the plurality of conducting wires and against sides of said passage way.

5. The arrangement in accordance with claim 1, wherein:

said shape of said plurality of prongs is slanted, and said passage way adjacent said second end is smaller than said passage way adjacent said first end in order to press said plurality of prongs in a sealing contact against the plurality of conducting wires and against sides of said passage way.

6. The arrangement in accordance with claim 1, wherein:

said passage way adjacent said second end includes a substantially half circle groove substantially complementary to a portion of one of the plurality of conducting wires;

two of said plurality of prongs each including a substantially quarter circle groove substantially complementary to a portion of one of the plurality of conducting wires, said shape of said two prongs and said passage way interacting when said lamp base is inserted into said lamp holder to cause said half circle and quarter circle grooves to combine into a substantially full circle around the one conducting wire.

7. The arrangement in accordance with claim 1, wherein:

two of said plurality of prongs each include a substantially half circle groove substantially complementary to a portion of one of the plurality of conducting wires, said shape of said two prongs and said passage way interacting when said lamp base is inserted into said lamp holder to cause said half circle grooves to combine into a substantially full circle around the one conducting wire.

8. The arrangement in accordance with claim 1, wherein:

said passage way adjacent said second end includes a substantially half circle groove substantially complementary to a portion of one of the plurality of conducting wires;

two of said plurality of prongs each including a substantially quarter circle groove and a substantially half circle groove substantially complementary to a portion of one of the plurality of conducting wires, said shape of said two prongs and said passage way interacting when said lamp base is inserted into said lamp holder to cause said half circle and quarter circle grooves to combine into two substantially full circles around two of the plurality of conducting wires.

9. The arrangement in accordance with claim 1, wherein:

two of said plurality of prongs each include three substantially half circle grooves substantially complementary to a portion of the plurality of conducting wires, said shape of said two prongs and said passage way interacting when said lamp base is inserted into said lamp holder to cause said half circle grooves to combine into three substantially full circles around the plurality of conducting wires.

10. The arrangement in accordance with claim 1, wherein:

said plurality of prongs taper in thickness from said second end of said lamp base to a reduced sized away from said second end of said lamp base.

11. The arrangement in accordance with claim 1, wherein:

an end of said plurality of prongs spaced from said second end of said lamp base is slanted.

12. The arrangement in accordance with claim 1, wherein:

said second end of said lamp base defines two filament apertures guiding filaments of the bulb out of said lamp base;

said lamp holder has a twin slant structure positionable between said two filament apertures and for move the filaments of the bulb radially outward when the lamp holder is slide onto said lamp base, said lamp holder also having a slider connected to said twin slant structure for sliding the filaments along an outside of said lamp base.

13. The arrangement in accordance with claim 1, wherein:

an outside of each of said prongs including a flange;

said passage way including a groove receiving said flange of said prongs.

14. A lamp socket arrangement for a bulb, the arrangement comprising:

a lamp base having a first end defining a bulb opening for receiving the bulb, said lamp base having a second end substantially opposite said first end, said second end including a plurality of prongs extending away from said second end, an outside of each of said prongs including a flange;

a lamp holder having first and second ends and defining a passage way between said first and second ends for receiving said lamp base, said plurality of prongs, and a plurality of conducting wires, said passage way, said plurality of prongs and the plurality of conducting wires having a shape to substantially fill said second end of said passage way when said plurality of prongs and the plurality of conducting wires are positioned in said second end of said passage way, said passage way including a groove receiving said flange of said prongs.

15. The arrangement in accordance with claim 14, wherein:

said shape of said plurality of prongs is slanted, and said passage way adjacent said second end is smaller than said passage way adjacent said first end in order to press said plurality of prongs in a sealing contact against the plurality of conducting wires and against sides of said passage way.

16. The arrangement in accordance with claim 14, wherein:

said passage way adjacent said second end includes a substantially half circle groove substantially complementary to a portion of one of the plurality of conducting wires;

two of said plurality of prongs each including a substantially quarter circle groove substantially complementary to a portion of one of the plurality of conducting wires, said shape of said two prongs and said passage way interacting when said lamp base is inserted into said lamp holder to cause said half circle and quarter circle grooves to combine into a substantially full circle around the one conducting wire.

17. The arrangement in accordance with claim 14, wherein:

two of said plurality of prongs each include a substantially half circle groove substantially complementary to a portion of one of the plurality of conducting wires, said shape of said two prongs and said passage way interacting when said lamp base is inserted into said lamp holder to cause said half circle grooves to combine into a substantially full circle around the one conducting wire.

18. The arrangement in accordance with claim 14, wherein:

said passage way adjacent said second end includes a substantially half circle groove substantially complementary to a portion of one of the plurality of conducting wires;

two of said plurality of prongs each including a substantially quarter circle groove and a substantially half circle groove substantially complementary to a portion of one of the plurality of conducting wires, said shape of said two prongs and said passage way interacting when said lamp base is inserted into said lamp holder to cause said half circle and quarter circle grooves to combine into two substantially full circles around two of the plurality of conducting wires.

19. The arrangement in accordance with claim 14, wherein:

two of said plurality of prongs each include three substantially half circle grooves substantially complementary to a portion of the plurality of conducting wires, said shape of said two prongs and said passage way interacting when said lamp base is inserted into said lamp holder to cause said half circle grooves to combine into three substantially full circles around the plurality of conducting wires.

20. The arrangement in accordance with claim 14, wherein:

said plurality of prongs taper in thickness from said second end of said lamp base to a reduced sized away from sa id second end of said lamp base.

21. The arrangement in accordance with claim 14, wherein:

an end of said plurality of prongs spaced from said second end of said lamp base is slanted.

* * * * *